United States Patent [19]

Schwartz

[11] Patent Number: 4,471,507

[45] Date of Patent: Sep. 18, 1984

[54] PAINT BRUSHES WITH DETACHABLE HANDLES

[76] Inventor: Marvin Schwartz, 6811 Mayfield Rd., Apt. #1295, Cleveland, Ohio 44124

[21] Appl. No.: 498,899

[22] Filed: May 27, 1983

[51] Int. Cl.[3] ..... A46B 7/04

[52] U.S. Cl. ..... 15/176; 15/144 B; 15/145; 15/194; 15/DIG. 4

[58] Field of Search ..... D4/38, 29; 15/143 R, 15/143 B, 144 R, 144 B, 145, 176, 190, 191 R, 192, 193, 194, 202, DIG. 4; 403/292, 298

[56] References Cited

U.S. PATENT DOCUMENTS

| | | | |
|---|---|---|---|
| 139,932 | 6/1873 | Sweetland | 403/298 X |
| D. 204,449 | 4/1966 | Zavodsky | D4/38 |
| 2,079,452 | 5/1937 | Hunter | 15/143 B |
| 2,799,883 | 7/1957 | Brady | 15/194 X |
| 2,868,602 | 1/1959 | Drezner | 403/298 |
| 2,969,996 | 1/1961 | White, Jr. | 15/145 X |
| 3,357,035 | 12/1967 | Ficke | 15/144 R |

FOREIGN PATENT DOCUMENTS

| | | | |
|---|---|---|---|
| 8781 | of 1884 | United Kingdom | 15/145 |

*Primary Examiner*—Peter Feldman

*Attorney, Agent, or Firm*—Harlan E. Hummer

[57] ABSTRACT

A paint brush is described as having a handle which is composed of two sections which are normally joined together in end-to-end relation, but which can be interchangeably used with a number of differently sized ferrules that contain fibers. The ferrules are each provided with a special adapter to which a single handle can be detachably mounted.

4 Claims, 3 Drawing Figures

PAINT BRUSHES WITH DETACHABLE HANDLES

BACKGROUND OF INVENTION

The invention relates to paint brushes, especially those which are used by highly skilled artisans, such as engravers, artists, sign painters and calligraphers to produce finer, more detailed work requiring the use of smaller brush hairs or bristles than those needed, for example, in the interior or exterior painting of a house.

The brushes used by such artisans number in the dozens and vary in size and shape depending on the manufacturer of the brush. It can be easily imagined that a large compartmented-type case must be used to store and transport the brushes. The invention solves this particular problem by the provision of a small, compact kit which contains a number of differently sized brush tips that can be interchangeably used with a single, two-piece handle.

Briefly stated, the invention is in a brush that can be used with any artistic medium, such as oil or watercolor paints, or ink. The brush has a metal ferrule for holding hairs or bristles, and a handle which is in axial alignment with the ferrule. Means, associated with the ferrule, are provided for detachably mounting the handle on the ferrule. Such means are carried by a number of differently sized ferrules which, because of such means, can be selectively mounted to the same handle.

Another aspect of the invention is the provision of a two-piece handle which is composed of two axially aligned sections which, when joined together, form a single, longer handle, but which are detachable from each other. Further, the rear section of the handle farthest spaced from the handle, is supplied with means whereby it can be detachably mounted to each of the ferrules, if a shorter handle brush is desired. Such is generally the case when a brush having a small number of bristles or hairs is used.

The sections of the handle each measure about four and one-half inches in length. The brush tips, including a ferrule and bristles or hairs, are shorter. Thus, a small compact carrying case measuring about four by six by three-quarters inches, can house a handle and four to six differently sized brush tips. The handle is made of plastic, rather than wood, so that broken handles are no longer a problem. Moreover, the use of a single handle substantially reduces the cost of a set of brushes wherein each of the brushes is provided with its own handle.

DESCRIPTION OF DRAWING

The following description of the invention will be better understood by having reference to the accompanying drawing, wherein.

DETAILED DESCRIPTION OF DRAWING

Figure 1:
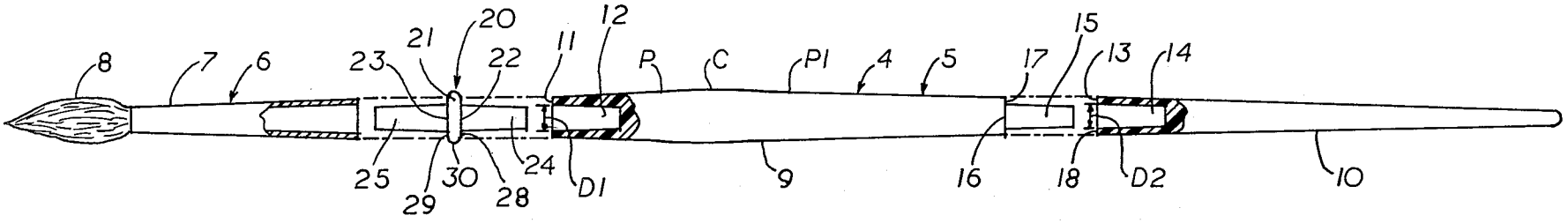
FIG. 1 is an exploded view of an artist's brush with certain portions, in section, to better illustrate the invention.

With general reference to the drawing for like parts, and particular reference to FIG. 1, there is shown an artist's paint brush 4 that is used, for example, in the painting of a landscape. The brush 4 has a handle 5 which is axially fastened to a tip 6 which consists of a generally frusto-conically shaped ferrule 7 that holds and terminates in a fibrous head 8 which, in turn, consists of a particular number of fibers which are, collectively, in any suitable shape, e.g. round or flat, and which are composed of any appropriate material, e.g. bristles, or natural hairs such as red sable, camel, or ox hairs, or any suitable synthetic hairs such as nylon hairs, or those manufactured by the F.M. Brush Co. of New York and sold under the trademark Golden Takalon, for holding and dispensing, for example, acrylic, oil, or water color paints, or ink.

The ferrule 7 is usually hollow and made of metal, the better ones being seamless and composed of a nickel alloy, and the less expensive ones being made of aluminum which has a seam that extends longitudinally of the ferrule.

Figure 2:
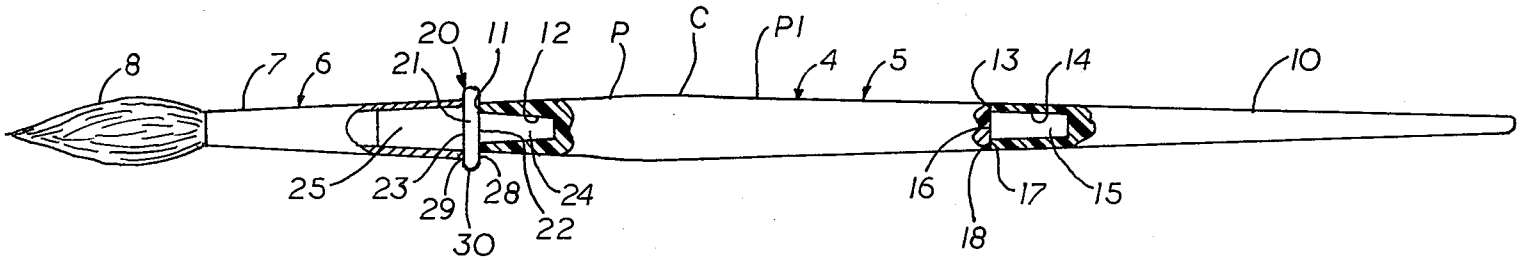
FIG. 2 is a side view of a larger brush with similar portions, in section, and which uses the handle shown in FIG. 1.

The handle 5 is composed of any appropriate, generally rigid plastic material, and is conventionally shaped as shown in FIGS. 1 and 2, being formed of two oppositely tapered, conical portions P and P1 which are joined by a smooth, barrel-shaped transitional surface C. The front portion P closest the ferrule 7, is much shorter, in length, and is more sharply tapered than the rear portion P1 which is farthest spaced from the ferrule 7. The handle 5, in this instance, is made of two pieces; namely, a front section 9 which is detachably mounted to the ferrule 7, and a rear section 10 which is, similarly, detachably mounted in axially aligned relation on the front section 9.

The front end 11 of the front section 9 of the handle 5, is provided with a frusto-conically shaped opening 12 which extends axially inwardly of the section 9. The front end 13 of the rear section 10 is, likewise, provided with an identically sized and shaped, frusto-conically shaped opening 14 which extends inwardly of the rear section 10. Thus, the diameters d1 and d2 of the openings 12,14 in the front ends 11,13 of the handle sections 9, 10, are the same.

The opening 14 in the rear section 10 of the handle 5, is designed to wedgingly and frictionally receive a matingly configured lug 15 which projects axially outwardly from the rear end 16 of the front section 9. An annular abutment 17 surrounds the protruding lug 15 at its base, and is designed to engage an annular stop 18 which is formed around the opening 14 in the rear section 10 of the handle 5, to limit axial movement of the two sections, 9,10 as they are brought together, so that the sections will not become so firmly wedged together that they cannot be separated. The handle 5 is detachably mounted on the tip 6 of the brush 4 by means of a special adapter 20 which is also composed of any suitable plastic material, and which is permanently bonded to the ferrule 7 by any appropriate bonding cement or adhesive.

The adapter 20 comprises a centrally disposed, generally cylindrical stop 21 which has a pair of opposing, parallel faces or surfaces 22,23, and a pair of frusto-conically shaped studs 24,25 which are integrally formed with the stop 21 and which extend in opposite, tapering, axially aligned relation from the faces 22,23 of the stop 21. The rearwardly facing stud 24, i.e. the stud confronting the handle 5, is always the same size and is identical in size and shape to the lug 15 which protrudes from the front section 9 of the handle 5, since it is also designed for mating reception in the openings 12,14 of the front and rear sections 9,10 of the handle 5. The forwardly facing stud 25 is made for reception in the hollow ferrule 7, the size of which varies with the size of the head 8, it being understood that a particular size ferrule can accommodate a certain range of fibers. Thus, the size of the stud 25 confronting the ferrule 7, will vary in accordance with the size of the tip 6 and ferrule 7 to which the adapter 20 is secured. It can also be appreciated that the taper of the studs 24,25 will generally correspond to the taper of the rear section 10 of the handle 5 and the ferrule 7, respectively. The overall diameter of the stop 21 of the adapter 20 is greater than the diameters of the adjacent bases of the studs 24,25, so that annular abutments 28, 29 are formed around the studs 24,25 for limiting axial movement of the handle 5 and ferrule 7 relative to the adapter 20. The outer surface 30 of the stop 21 is curved to provide an aesthetically pleasing transition between the tip 6 and handle 5 of the brush 4. The lug 15 and studs 24,25 have a length of about three-quarters of an inch, measured axially thereof, and the openings 12,14 have a corresponding depth, similarly measured, so that a snug fit exists between the parts, when they are joined together. To ensue such a fit, the lug or stud 15 and the stud 24 are made slightly larger than the openings 12,14.

Figure 3:
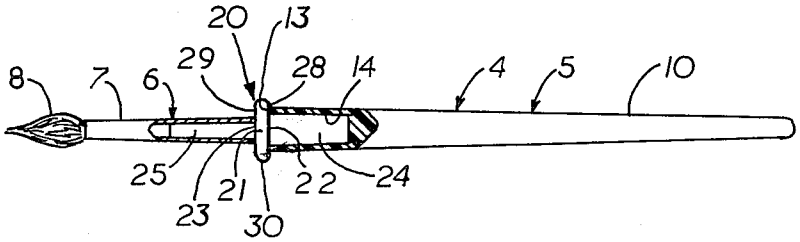
FIG. 3 is a similar side view of a smaller brush which uses only the rear section of the handle shown in FIG. 1.

As best seen in FIG. 3, the rear section 10 can be interchangeably used with the brush tip 6 to shorten the length of the handle 5 to provide better control of the brush 4, especially when a very small tip 6 is used for finer, more delicate brush strokes. The front and rear sections 9,10 of the handle 5, whichever is used, is given a slight twist as it is attached to, and detached from, the adapter 20 to provide greater ease of connecting and disconnecting these parts. The handle 5, being plastic and not wood, is less susceptable to wear to insure a snug fit between the handle and adapter.

Thus, there has been described a unique brush that utilizes a single, two piece handle that is readily adapted for use with a number of differently sized fiber containing ferrules to greatly reduce the large number of full size brushes that a skilled artisan must carry and use in the completion of a work, or project.

What is claimed is:

1. A set of brushes, comprising in combination:

(a) an axially elongated brush handle having a pair of opposing ends, at least one of which ends has, (i) a configured first opening which extends axially inwardly of the handle, and (ii) an annular stop around the opening;

(b) a plurality of differently sized brush tips for selective detachable mounting on the handle in axial alignment therewith, the tips having differently sized ferrules, each of which ferrules has a pair of opposing ends, one of which ends has a number of fibers extending therefrom in a particular shape, and the other of the ends has, (i) a configured second opening which extends axially inwardly of the ferrule and which has a size that is correlated to the size of the ferrule, and (ii) an annular stop around the second opening;

(c) means for selectively, detachably mounting each of the tips on the handle, including an adapter which is associated with, and secured to, each of the differently sized ferrules, each of the adapters having, (i) a generally cylindrical stop having a pair of opposing, parallel annular abutments, and (ii) a pair of studs extending in opposing axial relation from the cylindrical stop between the annular abutments, the first stud of the pair of studs being sized and shaped to fit in the opening in the associated ferrule, and the second stud of the pair of studs being sized and shaped to frictionally fit in the opening in the handle; thus, the first studs vary, in size, in correlated relation to the size of the ferrules, and the second studs are identical, in size, in correlated relation to the size of the opening in the handle, the studs being inserted in the openings until the stops contact the abutments.

2. The set of brushes of claim 1, wherein the studs of the adapters are frusto-conically shaped such that tapered sides of the studs converge in directions away from the cylindrical stop, the studs and openings in which they fit being matingly shaped.

3. The set of brushes of claim 2, wherein the ferrules are conventional hollow metal ferrules which are used, for example, in making artist's brushes, and the handle includes a plurality of sections which can be selectively, detachably mounted together and on the second studs of the adapters.

4. A set of brushes, comprising in combination:

(a) a plurality of differently sized brush tips, including differently sized hollow metal ferrules which terminate at a number of fibers which extend from each of the ferrules in a particular shape;

(b) a brush handle for selectively, detachably mounting on the brush tips in axial alignment with the ferrules in opposed relation from the fibers, the handle having a longitudinal axis and including:

(c) a first section for selectively, detachably mounting on the brush tips, the first section being adjacent the ferrule when mounted on a brush tip;

(d) a second section for selectively, detachably mounting on the brush tips and on the first section, depending on the length of the brush handle desired, the second section being spaced from the ferrule, when the sections are mounted, in tandem, on a brush tip; and (e) means for detachably mounting the second section in end-to-end relation on the first section, including, (i) a frusto-conically shaped first stud extending from the end of the first section farthest from the ferrule, the stud being concentrically formed about the longitudinal axis of the handle and having a smaller diameter than the first section adjacent thereto, such that an annular abutment is formed around the stud, and (ii) an opening formed in the end of the second section closest the ferrule, the opening shaped to matingly receive the first stud, but being slightly smaller than the first stud to frictionally engage the first stud when placed therein, the diameter of the opening being smaller than the diameter of the adjacent second section so that an annular stop is formed around the opening for engaging the annular abutment to limit movement of the sections towards each other, the adjacent abutting ends of the sections being equally sized so that the outer surfaces of the sections are in alignment, the end of the first section closest the ferrule, also having an opening therein which is identical, in size and shape, to the opening in the second section;

(f) means for detachably mounting the differently sized brush tips selectively on the first and second sections of the handle, including an adapter secured to each of the ferrules, each of the adapters comprising:

(g) a generally cylindrical stop having a pair of annular abutments which are in parallel planes and which face in opposite directions;

(h) a second stud which is identical, in size and shape, to the first stud and which extends from within one of the annular abutments in the direction of the handle for mating reception in the opening of the first section of the handle or, alternately, in the opening of the second section of the handle, where the annular abutment engages the annular stops surrounding the openings of the first or second sections, depending on which section is attached to the adapter;

(i) a third stud extending from within the other of the annular abutments in the direction of the ferrule for receipt therein, the third studs varying, in size, in correlated relation to the size of the ferrules; and (j) means for securing the third studs within correspondingly sized ferrules.

* * * * *